US009834933B2

(12) United States Patent
Schmidt

(10) Patent No.: US 9,834,933 B2
(45) Date of Patent: Dec. 5, 2017

(54) POST-TENSION CABLE PROTECTION SYSTEM, METHOD FOR INSTALLING THE SYSTEM AND METHOD FOR REMEDIATION OF A DEFECTIVE POST-TENSION REINFORCEMENT SYSTEM

(71) Applicant: John T. Schmidt, Sunrise, FL (US)

(72) Inventor: John T. Schmidt, Sunrise, FL (US)

( * ) Notice: Subject to any disclaimer, the term of this patent is extended or adjusted under 35 U.S.C. 154(b) by 0 days.

(21) Appl. No.: 15/365,002

(22) Filed: Nov. 30, 2016

(65) Prior Publication Data

US 2017/0204607 A1 Jul. 20, 2017

Related U.S. Application Data

(63) Continuation-in-part of application No. 15/153,133, filed on May 12, 2016, now abandoned, which is a continuation-in-part of application No. 14/995,703, filed on Jan. 14, 2016, now abandoned.

(51) Int. Cl.

| | |
|---|---|
| ***E04C 5/12*** | (2006.01) |
| ***E04C 5/16*** | (2006.01) |
| ***E04B 5/16*** | (2006.01) |

(52) U.S. Cl.

CPC ..... *E04C 5/122* (2013.01); *E04B 5/16* (2013.01); *E04C 5/161* (2013.01)

(58) Field of Classification Search

None

See application file for complete search history.

(56) References Cited

U.S. PATENT DOCUMENTS

| | | | | | |
|---|---|---|---|---|---|
| 3,107,983 | A | * | 10/1963 | Brandestini | E04C 5/125 264/228 |
| 3,405,490 | A | * | 10/1968 | La Marr | E04C 5/125 24/122.6 |
| 3,437,359 | A | * | 4/1969 | Hunter | E04C 5/125 24/115 R |
| 3,639,555 | A | * | 2/1972 | Steffan | B28B 3/00 264/140 |
| 4,348,844 | A | * | 9/1982 | Schupack | E04C 5/12 52/223.13 |
| 4,561,226 | A | * | 12/1985 | Tourneur | E04C 5/12 29/452 |

(Continued)

*Primary Examiner* — Brian E Glessner
*Assistant Examiner* — Adam G Barlow
(74) *Attorney, Agent, or Firm* — Laurence A. Greenberg; Werner H. Stemer; Ralph E. Locher

(57) ABSTRACT

An improved method of creating a waterproof seal for post tension cable systems roughens and decontaminates the cable's stressing end pocket with a diamond bladed reaming tool and closes the newly formed cavity with epoxy resin and a precasted plug made of non-shrink grout. The method includes pouring a concrete slab around an anchor and a pocket former through which a cable passes and is held by wedges. After the pocket former is removed and the cable is stressed, the cable is cut and a grease cap is applied. The system ensures that the cable is properly cut, the grease cap is properly seated, the inside of the pocket is roughened, and the seal at the cable's stressing end is waterproof. Furthermore, the invention aids in removing previously grouted pockets when cable remediation is needed and closing the pocket with a precasted plug when cable remediation is completed.

18 Claims, 6 Drawing Sheets

(56) References Cited

U.S. PATENT DOCUMENTS

| | | | | | |
|---|---|---|---|---|---|
| 4,719,658 | A * | 1/1988 | Kriofske | E04C 5/122 | 52/223.13 |
| 4,896,470 | A * | 1/1990 | Sorkin | B29C 45/14 | 52/223.13 |
| 5,042,337 | A * | 8/1991 | Rodriguez | B23D 23/04 | 30/228 |
| 5,058,469 | A * | 10/1991 | Rodriguez | B23D 23/04 | 83/13 |
| 5,079,879 | A * | 1/1992 | Rodriguez | E04C 5/12 | 24/122.6 |
| 5,347,777 | A * | 9/1994 | Sudduth | E04C 5/122 | 52/223.13 |
| 5,440,842 | A * | 8/1995 | Sorkin | E04C 5/12 | 52/223.13 |
| 6,098,356 | A * | 8/2000 | Sorkin | E04C 5/12 | 24/122.6 |
| 7,676,997 | B1 * | 3/2010 | Sorkin | E04C 5/12 | 52/223.13 |
| 7,797,895 | B1 * | 9/2010 | Sorkin | E04C 5/122 | 403/314 |
| 7,823,345 | B1 * | 11/2010 | Sorkin | E04C 5/122 | 24/122.3 |
| 7,841,140 | B1 * | 11/2010 | Sorkin | E04C 5/10 | 403/314 |
| 7,856,774 | B1 * | 12/2010 | Sorkin | E04C 5/122 | 24/122.6 |

* cited by examiner

POST-TENSION CABLE PROTECTION SYSTEM, METHOD FOR INSTALLING THE SYSTEM AND METHOD FOR REMEDIATION OF A DEFECTIVE POST-TENSION REINFORCEMENT SYSTEM

CROSS-REFERENCE TO RELATED APPLICATION

This application is a Continuation-in-Part of U.S. application Ser. No. 15/153,133, filed May 12, 2016, which was a Continuation-in-Part of U.S. application Ser. No. 14/995,703, filed Jan. 14, 2016; both applications are incorporated herein by reference in their entirety.

BACKGROUND OF THE INVENTION

Field of the Invention

The invention relates to a post-tension cable protection system and a method for installing such a system to be used in the construction of high-rise buildings or any other post-tension reinforced concrete structure. The invention also relates to a method for remediation of a defective post-tension reinforcement system.

Description of the Related Art

In high-rise building construction, steel cables or tendons in plastic sheathing are positioned in forms and on decks before concrete is poured so as to run through the center of a post-tensioned concrete slab. Such slabs used in residential construction are typically 8 inches thick and use 3,000 to 10,000 psi concrete. The tendons are stressed after the concrete has attained a compressive strength of no less than 75% of its 28 day strength as confirmed by field cured test cylinders. Modern tendons have seven high-strength steel wires wound together and placed inside the plastic sheathing. One end of the slab has a post-tension or PT anchor embedded in the concrete. The other end of the slab has a PT anchor and a pocket formed in an edge of the slab. The pocket is formed by a plastic pocket former that is later removed and leaves an opening which the PT cable runs through. The opening made by the pocket former is large enough so that the cable end can be cut to the correct length and a grease cap can then be applied. The PT cable is stressed and must meet the 7% tolerance required for elongation. After stressing and removal of the plastic pocket former, the tendons ends are cut off within the pockets in which the anchors are located and the pockets are filled with grout to protect them from corrosion. PT concrete is superior in strength to steel-reinforced concrete which is not tensioned.

The problem which occurs is that even when using non-shrink grout, over time the grout will shrink and a gap will develop which allows moisture to enter. Human error in mixing and a need to retemper the grout mix over extended periods of time contributes to the problem. The moisture causes corrosion which can lead to failure, requiring remediation, especially near the ocean where moisture and salt content in the air are high. Conventional approaches to sealing the cavity have been unsuccessful which requires difficult and expensive remediation. Another problem associated with grouting is that traditional grouting methods do not bond the grout to the smooth concrete finish left by the pocket former. While traditional methodology calls for roughing the pocket surface with a wire brush, a wire brush has little to no impact on concrete stronger than 2000 PSI. When there is no bond, water ingression is likely. Wet packing of grout to a hardened and contaminated concrete surface is also very problematic.

U.S. Pat. No. 4,719,658 to Kriofske discloses the sealing of an anchor in post-tension systems and specifically states that it is preferable if the grease cap does not fit snug with the anchor. However, according to current building codes, a grease cap must be properly seated within the base plate. The distance from the end of a properly seated grease cap to the face of the slab is exactly 1 inch. Current building codes call for a 1 inch minimum coverage over the grease cap to ensure that the cable is protected in aggressive environments. If the grease cap is not properly seated, which is noted as preferable in Kriofske's patent, the 1" minimum requirements cannot be achieved and a PT plug would not be able to fit the cavity since it is configured to fit only when a grease cap is properly seated. Furthermore, if the grease cap is not properly seated into the anchor and grease is pumped into the cavity, the excess grease will escape from under the cap and enter the rest of the cavity. A patch cannot be made in the presence of grease which is a bond breaker and must be completely removed. Using a wire brush as noted in traditional methods does not remove grease nor does it roughen the surface.

U.S. Pat. No. 3,639,555 to Steffan teaches a method of making a concrete plug. The plugs are used for architectural finishing and are therefore only provided for aesthetic purposes. The use of concrete for patch material in post-tension systems is specifically prohibited by code in substantially every jurisdiction because it shrinks too much to provide even minimal protection from moisture intrusion. The combination of metallic traces and concrete's relatively high levels of shrinkage make it a very poor and prohibited patch material for cable ends.

U.S. Pat. No. 4,502,554 to Jones teaches an expansible tool for reaming undercuts in cylindrical holes in order to place bolts in the holes. The reaming tool of Jones requires flooding the cavity with water and other fluids to flush out concrete cuttings and cool the cutting tool during the reaming process. However, the use of water would promote corrosion in post-tension systems which is exactly what a grease cap and a patch are supposed to prevent. The addition of water or any other fluid to a Post Tension Cable Systems is strictly forbidden.

BRIEF SUMMARY OF THE INVENTION

It is accordingly an object of the invention to provide a post-tension cable protection system and a method for installing the system, which overcome the hereinafore-mentioned disadvantages of the heretofore-known systems and methods of this general type and which prevent moisture intrusion and therefore eliminate the need for remediation at PT pockets in building systems.

It is a further object of the invention to reactively fix and replace the poorly grouted cable ends that are removed during remediation. After 10 years, a building is due for a full inspection of its integrity. When post tension cable remediation is needed, a reaming tool of the invention can be used to remove the poorly grouted cable ends which can be replaced with a PT plug once the remediation is complete. Current remediation methods include using a chipping hammer at the grouted end. That becomes problematic when trying to carefully chip away the preexisting grout while not coming into contact with the grease cap, cable, or wedges.

With the foregoing and other objects in view there is provided, in accordance with the invention, a post-tension reinforcement system for building construction. The system comprises a concrete slab having an edge and a pocket formed in the edge, an anchor embedded in the slab, wedges disposed within the anchor, a cable passing through the slab, being held by the wedges and having an end within the pocket, and a prefabricated reinforcement plug formed of high strength non-shrink, non-metallic grout closing the pocket at the edge and being sealed to the slab in a waterproof manner with an adhesive after a reaming tool has created a cleaned and roughened surface in the pocket.

With the objects of the invention in view, there is also provided a method for waterproofing a post-tension concrete reinforcement system for building construction. The method comprises placing an anchor and a pocket former over a cable, pouring a concrete slab around the anchor and the pocket former disposed on the cable, removing the pocket former from an edge of the slab to form a pocket through which the cable extends, placing wedges on the cable within the anchor, stressing or pulling and elongating the cable at the edge while using the wedges to prevent the cable from retracting, cutting the cable within the pocket, applying a grease cap to the cut cable end, reaming-out the pocket, closing the pocket with a prefabricated reinforcement plug made of high strength, non-shrink, non-metallic grout, and sealing the reinforcement plug to the slab in a corrosion inhibiting manner using an adhesive. The reaming tool is a diamond-plated reaming tool which cleans and roughens the surface within the pocket.

This post-tension system and method provide a waterproof seal which avoids costly PT cable remediation due to corrosion to the cabling system caused by water vapor intrusion. If remediation is required on buildings that relied on convention grout patching methods, the reaming tool can be used to remove existing grouted cable ends which are to be then protected with a precast plug made of non-shrink grout after the inspection and remedial work, if required, are complete.

The pocket is reamed-out with the reaming tool before closing the pocket with the prefabricated plug. Preferably, the reaming tool has diamond sections. The reaming tool provides a roughened, cleaned and decontaminated surface of the pocket. Additionally, the reaming tool is constructed with a 1.5 inch recess in the center of the tool accommodating the grease cap and cable during the reaming process. It is important to avoid contact with the grease cap and the cable when roughening the surface, noting that any impact to the cable or grease cap could loosen the wedges and cause the cable to retract. When remediation is required and the previously grouted cable ends must be removed, conventionally used chipping hammers had to be used with extreme caution to ensure they did not come into contact with the cable. The reaming tool's recess and structure make it impossible to come into contact with the grease cap during the roughening and remediation process.

In accordance with a further feature of the invention, the pocket former is formed of molded plastic or sheet metal and therefore can be mass-produced in a mold and can be customized to accommodate any size, shape, and thickness required for a specific application.

In accordance with an added feature of the invention, the grease cap containing grease covers the end of the cable in the pocket. The grease is intended to prevent rust formation.

One of the main reasons that corrosion occurs is because grease caps are not properly seated. The combination of poorly grouted cable ends and unseated grease caps allows water to run directly from the facade of the building to the cable and wedges. Any rust formation at the wedges and cable can cause the cables to become loose and retract. In prior art systems it is very difficult to tell whether or not a grease cap is properly seated since workers pack the pocket with soft grout and there is no resistance due to the fluid nature of uncured grout. However, according to the invention, the PT plug is a check to ensure that the grease cap is seated correctly. The plug is 1¼" thick with a ¼" depression. The distance from the end of a properly seated grease cap to the face of the slab is exactly 1 inch. A 1" distance when properly seated equals a 1" thickness of middle of the plug. This means that if the plug does not fit exactly flush with the slab end, it is an indication that the grease cap is not properly seated and is not serving as an effective moisture block. In such cases, the grease cap must be repositioned and pushed flush against the base plate which the cable runs through. The PT plug therefore serves to validate the proper seating of the grease cap to the base plate. In the simplest sense, it checks to make certain that the grease cap is properly seated.

In accordance with an additional feature of the invention, the adhesive is an epoxy adhesive. Epoxy provides an excellent waterproof seal.

In accordance with yet another feature of the invention, the material of the plug is a precast, high-strength grout or similar material that will not shrink. In this way, the plug is compatible with the material of the slab. The high-strength, non-shrink, non-metallic grout complies with building code standards. The standard for patch material is that it must meet ASTM C1107. It is critical to note that the pocket cannot be patched with concrete because concrete shrinks too much.

With the objects of the invention in view there is concomitantly provided a method for remediating a conventional post-tension concrete reinforcement system for building construction. The conventional post-tension concrete reinforcement system includes a concrete slab having an edge, a pocket formed in the edge, an anchor embedded in the slab, wedges disposed within the anchor, a cable passing through the slab, being held by the wedges and having an end within the pocket, and grout closing the pocket. The method comprises removing the grout and exposing the end of the cable in the pocket, reaming-out the pocket to provide a clean and rough surface of the pocket, placing a prefabricated reinforcement plug formed of grout against the reamed-out clean and rough surface of the pocket to close the pocket at the edge, and sealing the prefabricated reinforcement plug to the reamed-out clean and rough surface of the pocket in a waterproof manner with an adhesive.

Other features which are considered as characteristic for the invention are set forth in the appended claims.

Although the invention is illustrated and described herein as embodied in a post-tension cable protection system, a method for installing the system and a method for remediation of a defective post-tension reinforcement system, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from the following description of specific embodiments when read in connection with the accompanying drawings.

DETAILED DESCRIPTION OF THE INVENTION

Figure 1:
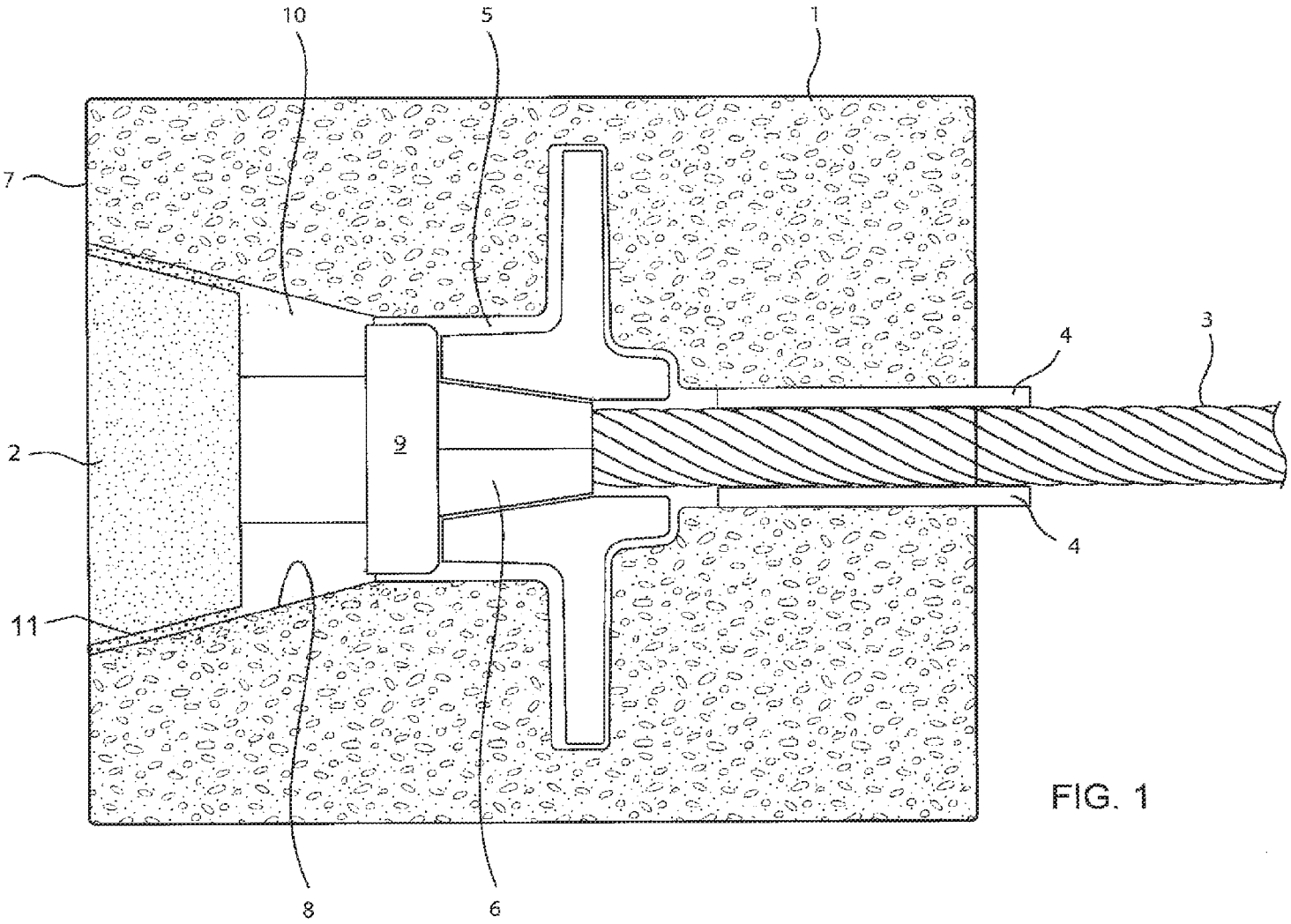
FIG. 1 is a fragmentary, diagrammatic, longitudinal-sectional view of a concrete slab having a completed post-tension reinforcement plug system disposed therein according to the invention.

Referring now to the figures of the drawing in detail and first, particularly, to FIG. 1 thereof, there is seen a completed post-tension reinforcement plug system according to the invention which is installed at the stressing end of a post-tensioned concrete slab 1. The system includes a post-tension or PT reinforcement and corrosion-inhibiting plug 2 and a post-tension tendon or cable 3 which is covered with a plastic sheathing 4 in which grease is provided between the sheathing 4 and the cable 3. The plug 2 is prefabricated from a high-strength, non-shrink, non-metallic grout that complies with industry standards. The plug 2 cannot be made of concrete due to industry standards and the relatively high shrinkage rate of concrete.

Figure 12:
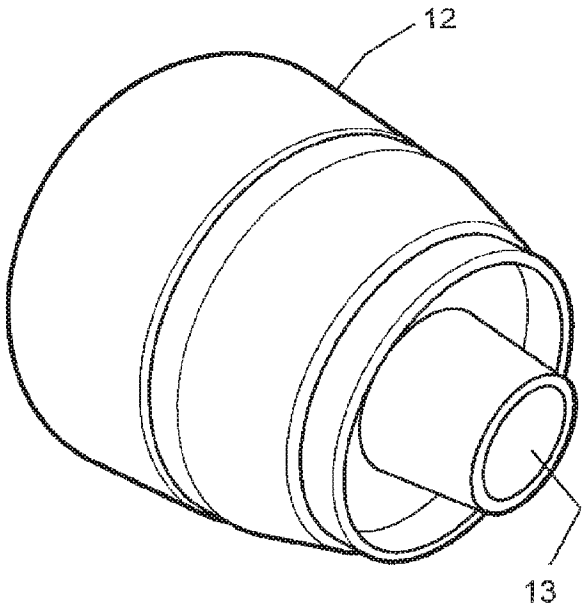
FIGS. 12 and 13 are perspective views of a molded pocket former.
Figure 13:
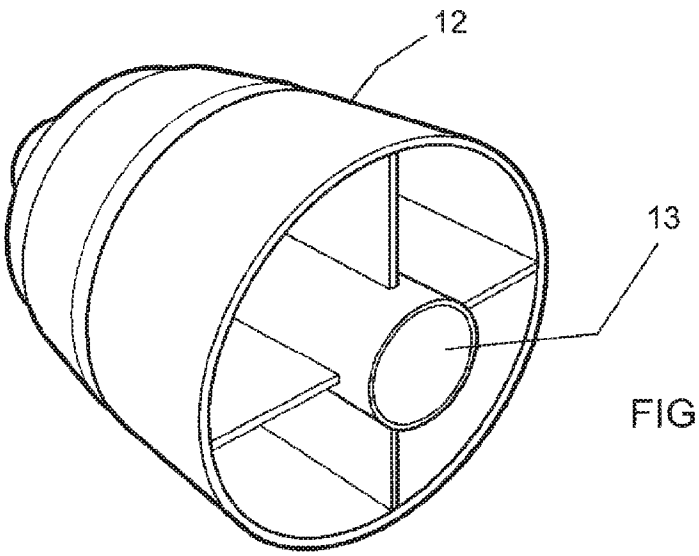

According to the method of the invention, the sheathing 4 and a metal anchor or embed 5 are placed over the cable 3. A plastic pocket former 12 seen in FIGS. 12 and 13 is also placed over the cable 3 so that the cable passes through a hole 13 in the plastic pocket former 12.

Figure 4:
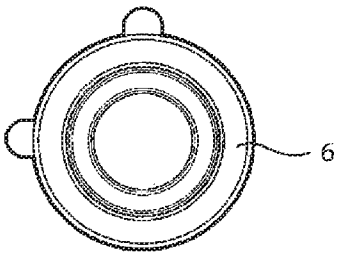
FIG. 4 is a top-plan view of a grease cap.
Figure 7:
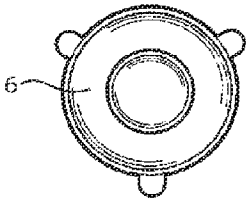
FIG. 7 is a bottom-plan view of the grease cap.
Figure 11:
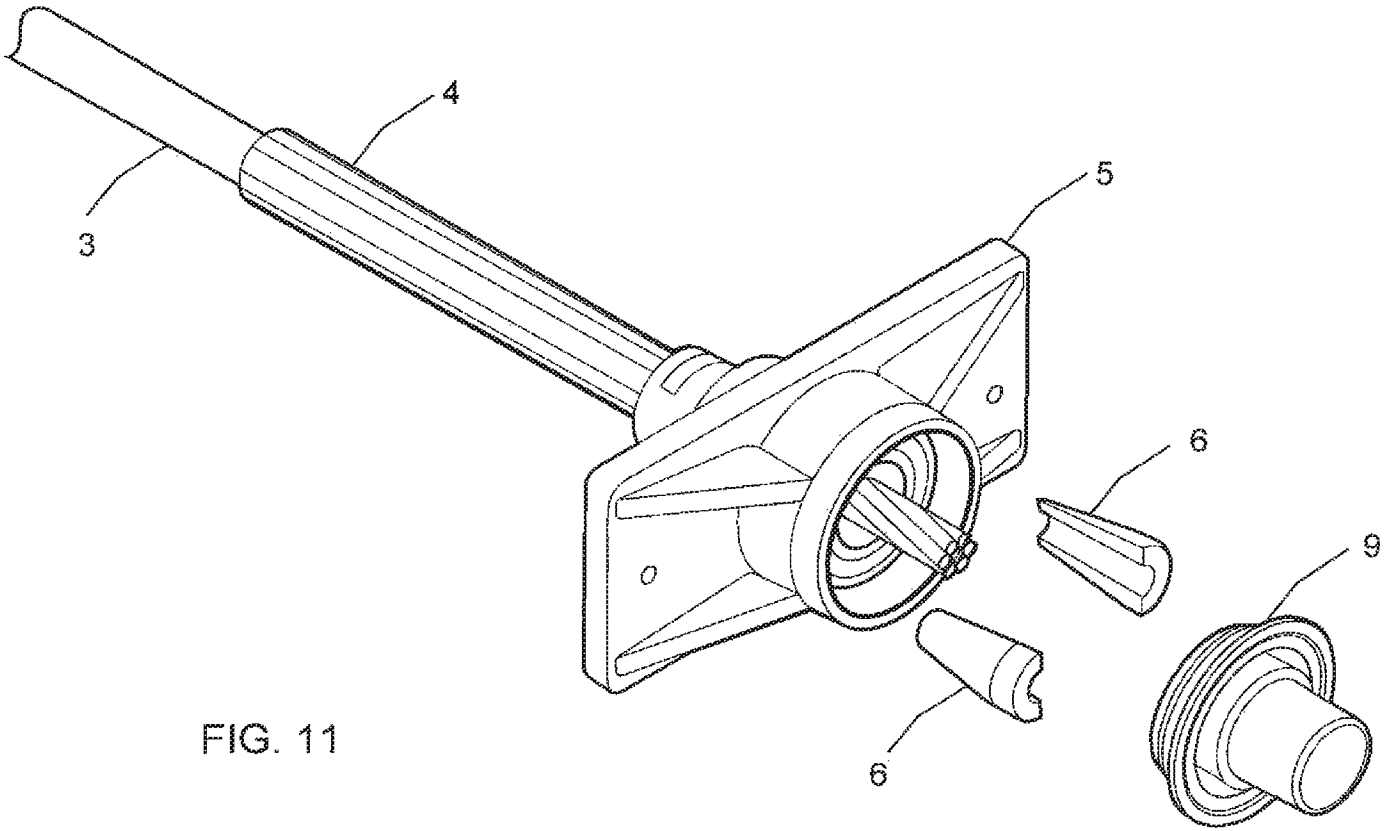
FIG. 11 is an exploded, perspective view of a post-tension anchorage system.

The concrete slab 1 is then poured in forms around the cable 3 having the sheathing 4, the anchor 5 and the plastic pocket former 12 so that after the concrete cures, the plastic pocket former 12 can be removed leaving a PT pocket 8 between the anchor 5 and an edge 7 of the slab 1. The other end of the cable remains stationary in the slab. The cable 3 then extends out of the pocket 8 about 12 inches to the left in FIG. 1. Wedges 6 shown in FIG. 11 are placed on the cable after the concrete is poured and cured (about 12-16 hours after pouring). The cable 1 is pulled to the left in FIG. 1 by a stressing machine which pulls the cable tight while keeping the wedges tight against the anchor so as to elongate and tension the cable. The cable 1, which is prevented from retracting by the wedges 6, is then cut or severed with a torch or other cutting device within the pocket 8 and covered with grease. A grease cap 9 is placed over the cut end of the cable, so that a length of the cable 3 of between ½ and ¾ of an inch remains within the smaller diameter part of the grease cap 9. The grease cap 9 is shown separately in FIGS. 4 and 7.

Figure 5:
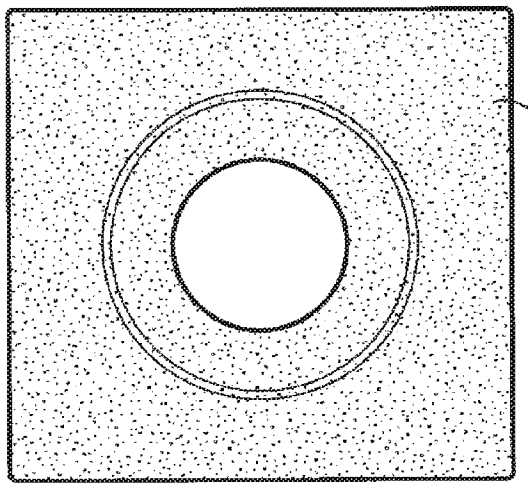
FIG. 5 is a vertical-sectional view of a reamed-out pocket in the slab.
Figure 10:
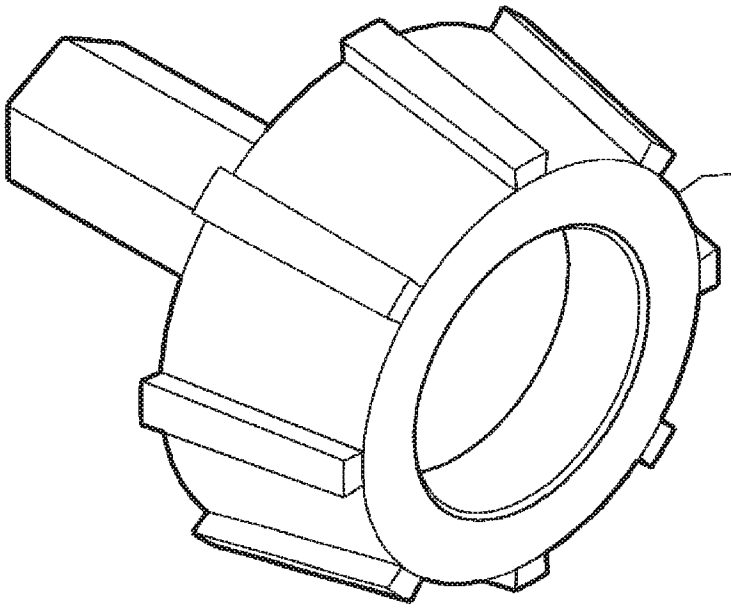
FIG. 10 is a perspective view of a reaming tool for reaming-out the pocket in the slab.

According to the invention, a surface 10 of the pocket 8 towards the edge 7 of the slab 1 is reamed out and roughened with a grinding tool or reamer 14 shown in FIG. 10. The reaming is dry reaming which is carried out without the aid of water or other fluids, in contrast to the prior art. The reamer 14, which preferably has diamond sections, provides a roughened, cleaned and decontaminated surface 10 of the pocket 8 as seen in FIG. 5. The reaming removes about 1/16"-⅛" off the inner surface of the pocket, creating a shelf for the PT plug to rest in. The shelf creates a seat on which the PT plug can rest. The reaming tool has a 1.5 inch recess in the center of the tool for accommodating the grease cap and cable during the reaming process. It is important to avoid contact with the grease cap and the cable when roughening the surface, because any impact with the cable or grease cap could loosen the wedges and cause the cable to retract.

Figure 3:
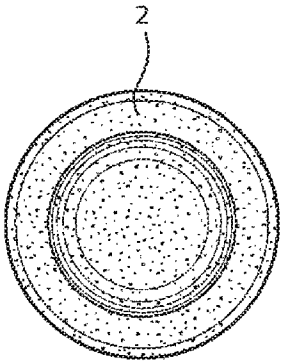
FIG. 3 is a bottom-plan view of a PT plug.
Figure 6:
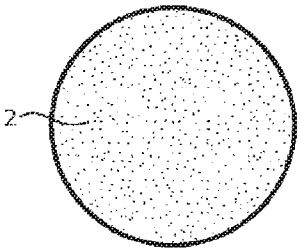
FIG. 6 is a top-plan view of the PT plug.

Epoxy adhesive is applied both to the inner surface of the pocket 8 and to the outer surface of the reinforcement plug 2, which is seen separately in FIGS. 3 and 6. The reinforcement plug 2 is tapped into place with a rubber mallet so as to close the pocket 8 and cover the grease cap 9. The reinforcement plug 2 is generally either 2.75" or 3.00" in diameter, but it could have a different diameter as well. The reinforcement plug 2 has a thickness of 1.25" with a recess of ¼" in the middle to accommodate the grease cap. This recess is configured to provide a 1" minimum coverage needed in aggressive environments while also acting as a check to make sure that the grease cap is properly seated.

Figure 2:
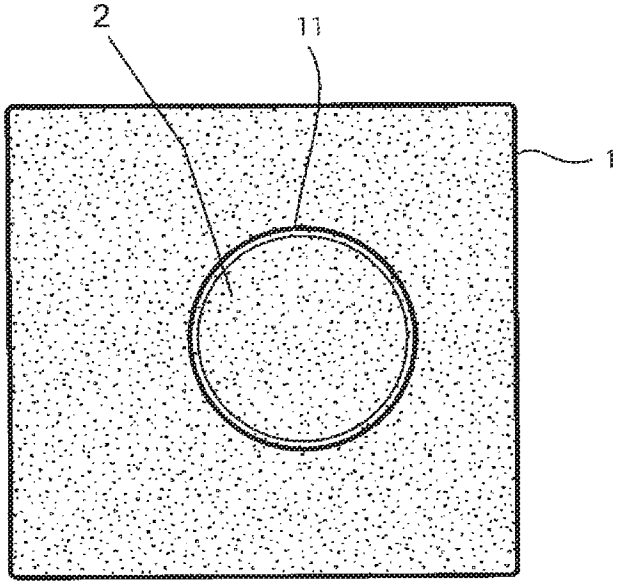
FIG. 2 is a cross-sectional view of a portion of the slab showing an adhesive bead therein around a plug.
Figure 8:
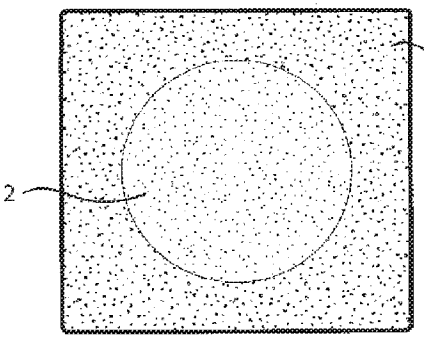
FIG. 8 is a vertical-sectional view of a portion of the slab showing the plug.
Figure 9:
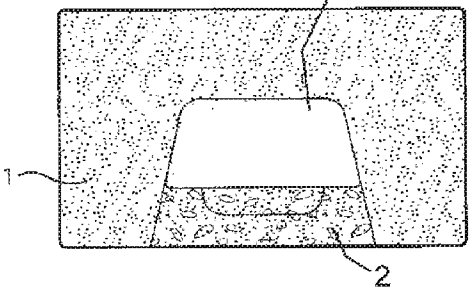
FIG. 9 is a cross-sectional view of the slab in which the plug is disposed and the grease cap has been omitted for clarity.

It can be seen from FIG. 2 that a bead 11 of epoxy remains around the plug 2 in the pocket 8 and even when the slab is cut as shown in FIGS. 8 and 9, the plug 2 is nearly indistinguishable from the slab 1. The bead 11 of epoxy is also shown in FIG. 1 from which it can be seen that a space between the reinforcement plug 2 and the grease cap 9 around the end of the anchor 5 is empty. A completely waterproof pocket is thus formed.

The invention claimed is:

1. A post-tension reinforcement system for building construction, the system comprising:

a concrete slab having an edge and a pocket formed in said edge, said pocket having a reamed-out clean and rough surface;

an anchor embedded in said slab;

wedges disposed within said anchor;

a cable passing through said slab, being held by said wedges and having an end within said pocket; and a prefabricated reinforcement plug formed of non-shrink grout, said reinforcement plug closing said pocket at said edge and being sealed to said reamed-out clean and rough surface of said pocket in a waterproof manner with an adhesive.

2. The system according to claim 1, which further comprises a grease cap covering said end of said cable in said pocket.

3. The system according to claim 1, wherein said adhesive is an epoxy adhesive.

4. The system according to claim 1, wherein said reinforcement plug is formed of high-strength, non-metallic grout.

5. The system according to claim 2, which further comprises grease disposed within said grease cap.

6. The system according to claim 2, wherein said reinforcement plug has an outer surface, and an accuracy of a location of said grease cap in said pocket is determined by a degree of alignment of said outer surface of said reinforcement plug with the edge of the slab.

7. A method for waterproofing a post-tension concrete reinforcement system for building construction, the method comprising the following steps:

placing an anchor and a pocket former over a cable;

pouring a concrete slab around the anchor and the pocket former disposed on the cable;

removing the pocket former from an edge of the slab to form a pocket through which the cable extends;

placing wedges on the cable within the anchor;

stressing and elongating the cable at the edge while using the wedges to prevent the cable from retracting;

cutting the cable within the pocket;

reaming-out the pocket;

closing the pocket with a prefabricated reinforcement plug formed of non-shrink grout; and sealing the reinforcement plug to the slab in a waterproof manner using an adhesive.

8. The method according to claim 7, which further comprises placing a grease cap on a cut edge of the cable within the pocket before closing the pocket.

9. The method according to claim 7, wherein the adhesive is an epoxy adhesive.

10. The method according to claim 7, wherein the reinforcement plug is formed of high-strength, non-shrink, non-metallic grout.

11. The method according to claim 8, which further comprises placing grease within the grease cap.

12. The method according to claim 7, which further comprises carrying out the step of reaming-out the pocket with a reaming tool providing a clean and roughened surface in the pocket before closing the pocket with the prefabricated plug.

13. The method according to claim 12, wherein the reaming tool has diamond sections.

14. The method according to claim 7, wherein the pocket former is formed of molded plastic.

15. The method according to claim 8, which further comprises determining an accuracy of a location of the grease cap in the pocket by observing a degree of alignment of an outer surface of the reinforcement plug with the edge of the slab.

16. The method according to claim 12, which further comprises placing a grease cap on a cut end of the cable within the pocket before closing the pocket, and providing a recess in the reaming tool for accommodating the grease cap and the cable end during reaming.

17. A method for remediating a conventional post-tension concrete reinforcement system for building construction, the method comprising the following steps:

providing a conventional post-tension concrete reinforcement system including a concrete slab having an edge, a pocket formed in the edge, an anchor embedded in the slab, wedges disposed within the anchor, a cable passing through the slab, being held by the wedges and having an end within the pocket, and grout closing the pocket;

removing the grout and exposing the end of the cable in the pocket;

reaming-out the pocket to provide a clean and rough surface of the pocket;

placing a prefabricated reinforcement plug formed of non-shrink grout against the reamed-out clean and rough surface of the pocket to close the pocket at the edge; and sealing the prefabricated reinforcement plug to the reamed-out clean and rough surface of the pocket in a waterproof manner with an adhesive.

18. The method according to claim 17, which further comprises placing a grease cap over the cable end, carrying out the reaming step by using a reaming tool, and providing a recess in the reaming tool for accommodating the grease cap and the cable end during reaming.

* * * * *